US008573094B2

(12) United States Patent
Pullen

(10) Patent No.: US 8,573,094 B2
(45) Date of Patent: Nov. 5, 2013

(54) OIL FILTER WRENCH

(75) Inventor: Gary L. Pullen, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 447 days.

(21) Appl. No.: 12/549,122

(22) Filed: Aug. 27, 2009

(65) Prior Publication Data

US 2010/0050821 A1 Mar. 4, 2010

Related U.S. Application Data

(60) Provisional application No. 61/092,611, filed on Aug. 28, 2008, provisional application No. 61/184,325, filed on Jun. 5, 2009.

(51) Int. Cl.
*B25B 13/52* (2006.01)

(52) U.S. Cl.
USPC ..... 81/64; 81/3.43

(58) Field of Classification Search
USPC ..... 81/64, 3.43, 69, 900, 177.7, 186
See application file for complete search history.

(56) References Cited

U.S. PATENT DOCUMENTS

| | | | | |
|---|---|---|---|---|
| 4,007,650 | A * | 2/1977 | Wellman | 81/64 |
| 4,010,662 | A * | 3/1977 | Perrault | 81/64 |
| 4,552,040 | A * | 11/1985 | Bang | 81/65 |
| 5,090,274 | A | 2/1992 | Schaub | |
| 5,388,485 | A * | 2/1995 | Auble | 81/64 |
| 5,595,094 | A | 1/1997 | Negus | |
| 6,520,052 | B1 * | 2/2003 | Saunders et al. | 81/64 |
| 7,708,499 | B1 * | 5/2010 | Evarts et al. | 405/232 |
| 2009/0217790 | A1 * | 9/2009 | Harter | 81/129 |

OTHER PUBLICATIONS

Archived web page for Carbinite(TM) Metal Coatings, Feb. 2, 2001, found through Wayback Machine.*
CarbiniteTM metal coatings—A Unique Carbinde Alloy Coating with many practical applicatior "Non-Slip Step", at least as early as 2008, 2pp.
Lisle Corporation Invention Disclosure Agreement dated Mar. 9, 1984.
Lisle Corporation Invention Disclosure Agreement dated Feb. 19, 1986.
Lisle Corporation Invention Disclosure Agreement dated Sep. 3, 1987.
Lisle Corporation Invention Disclosure Agreement dated Feb. 26, 1991.
Lisle Corporation Invention Disclosure Agreement dated Jun. 3, 1991.
Lisle Corporation Invention Disclosure Agreement dated Apr. 2, 1992.
Lisle Corporation Invention Disclosure Agreement dated May 21, 1992.
Lisle Corporation Invention Disclosure Agreement dated Jul. 29, 1994.
Lisle Corporation Invention Disclosure Agreement dated Jan. 30, 1995.

(Continued)

*Primary Examiner* — Robert Scruggs
(74) *Attorney, Agent, or Firm* — Banner & Witcoff, Ltd.

(57) ABSTRACT

An oil filter wrench includes a flexible stainless steel band having a pattern of sputtered alloy material coating at least part of the inside surface of the band to enhance the gripping ability of the oil filter wrench as the band is tightened above the outside surface of a cylindrical canister during removal or installation of the oil filter canister.

13 Claims, 6 Drawing Sheets

(56) References Cited

OTHER PUBLICATIONS

Lisle Corporation Invention Disclosure Agreement dated Apr. 12, 1996.
Lisle Corporation Invention Disclosure Agreement dated Sep. 10, 1998.
Lisle Corporation Invention Disclosure Agreement dated Nov. 22, 1998.
Lisle Corporation Invention Disclosure Agreement dated Jan. 12, 1999.
Lisle Corporation Invention Disclosure Agreement dated Apr. 19, 1999.
Lisle Corporation Invention Disclosure Agreement dated Aug. 24, 2000.
Lisle Corporation Invention Disclosure Agreement dated Aug. 15, 2001.
Lisle Corporation Invention Disclosure Agreement dated Apr. 2, 2008.

* cited by examiner

FIG.1
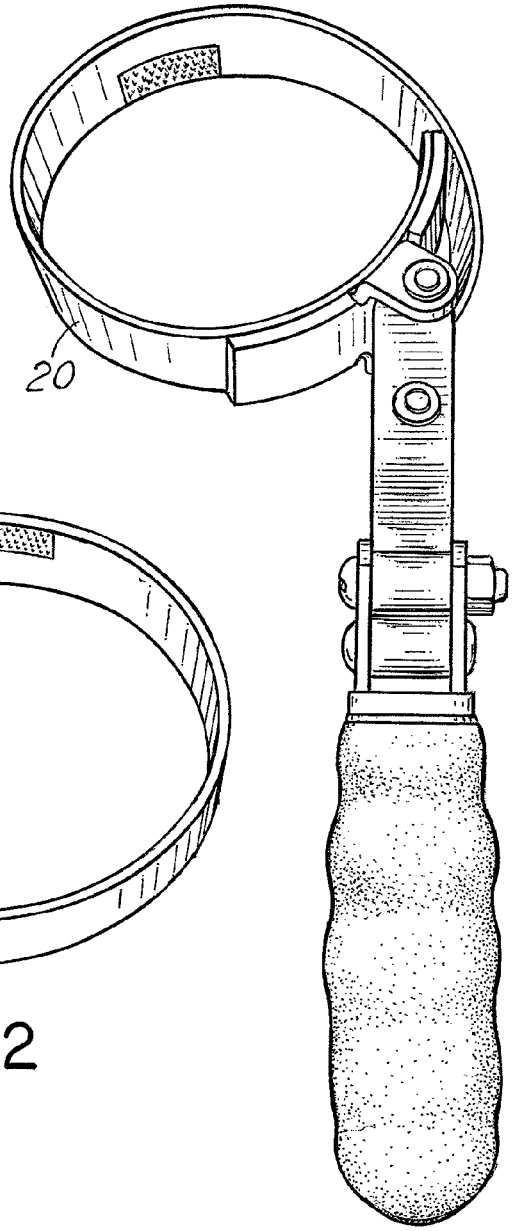
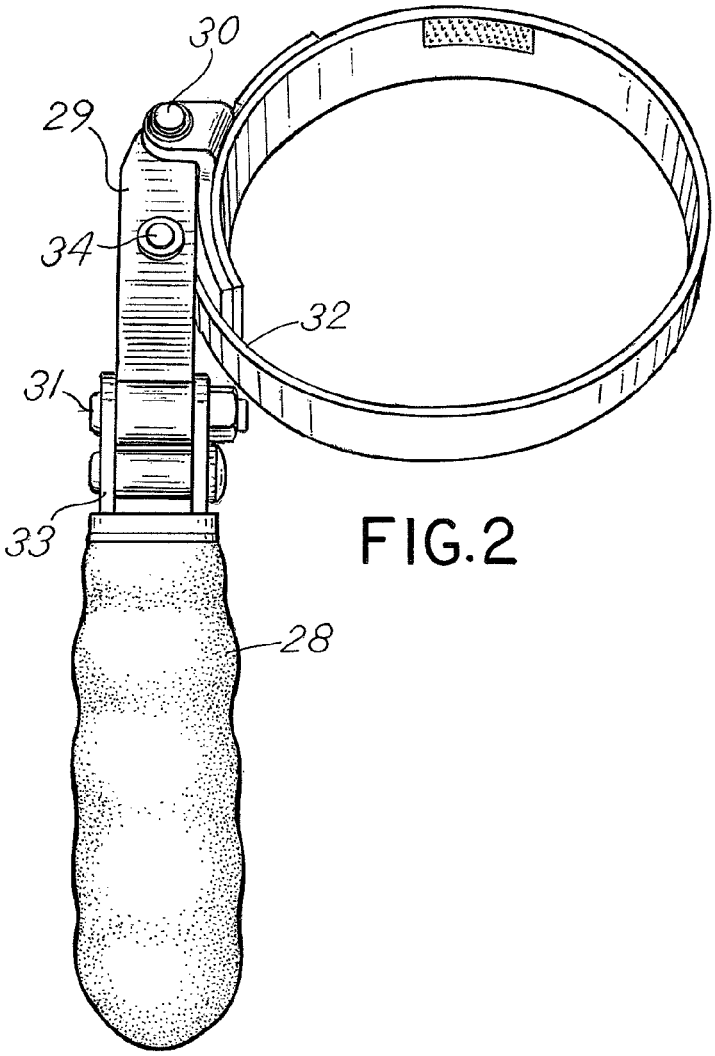
FIG.2

FIG. 5
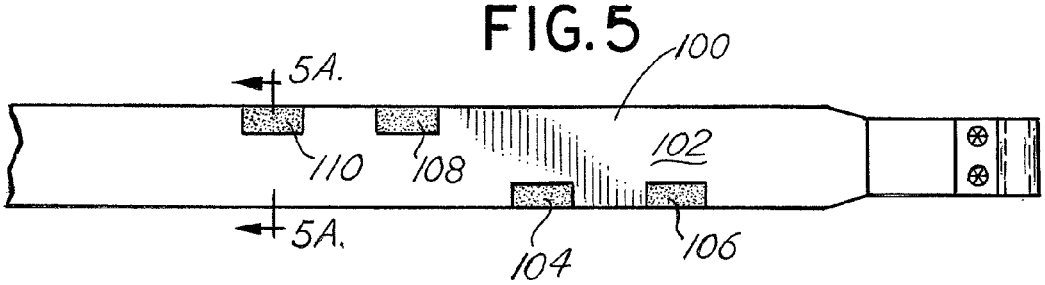
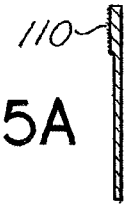
FIG. 5A
FIG. 5B
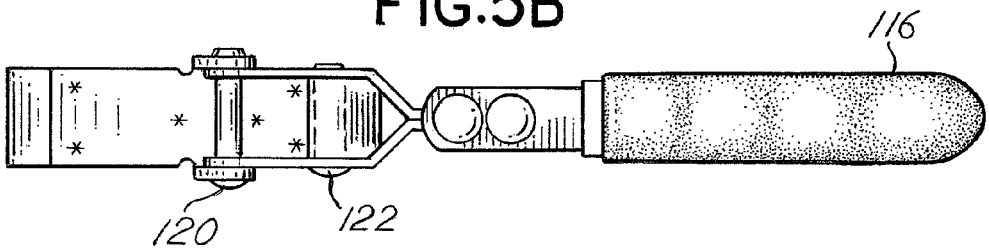
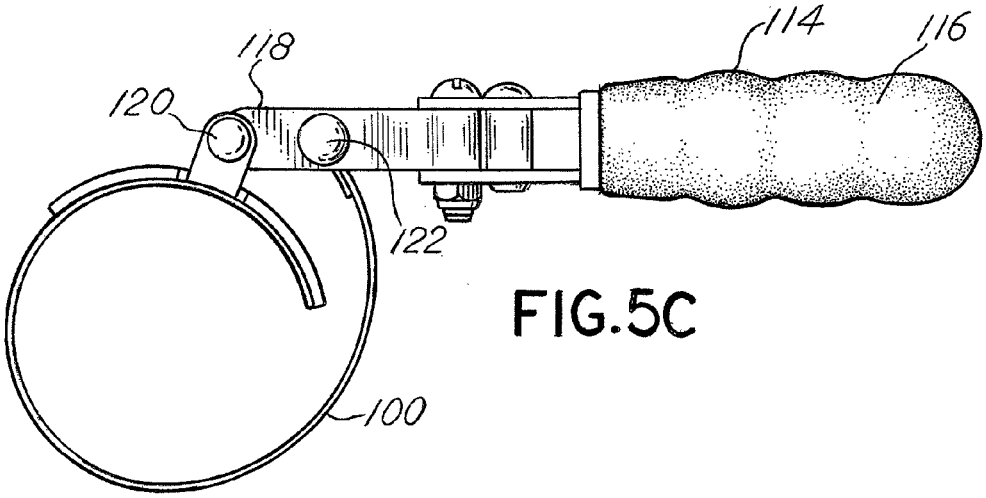
FIG. 5C

FIG.6
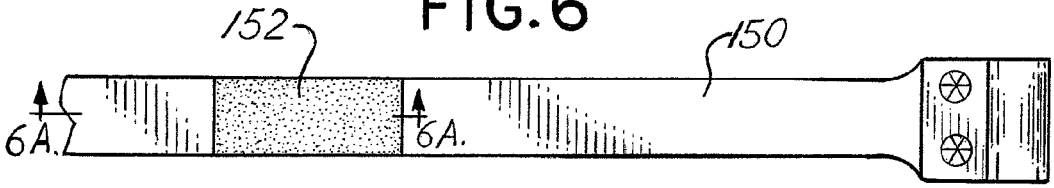
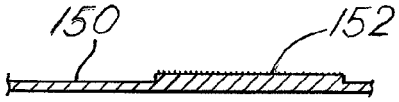
FIG.6A
FIG.6B
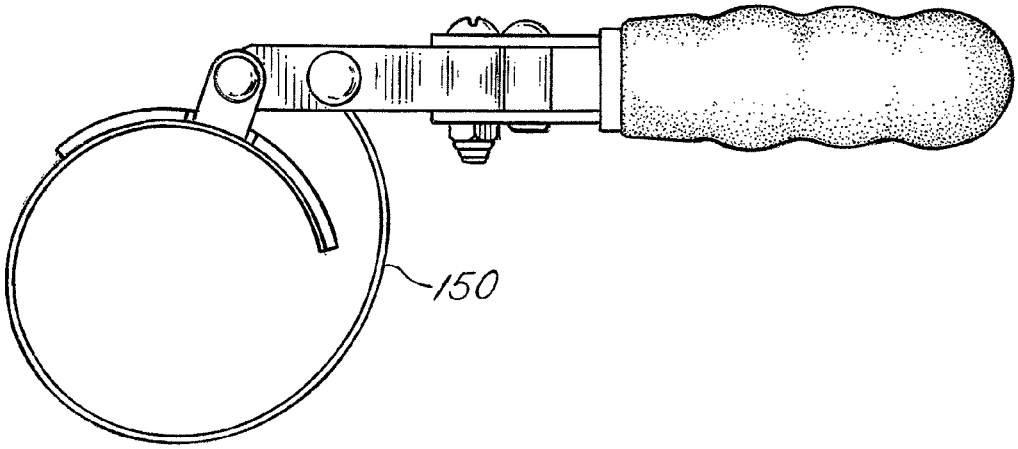

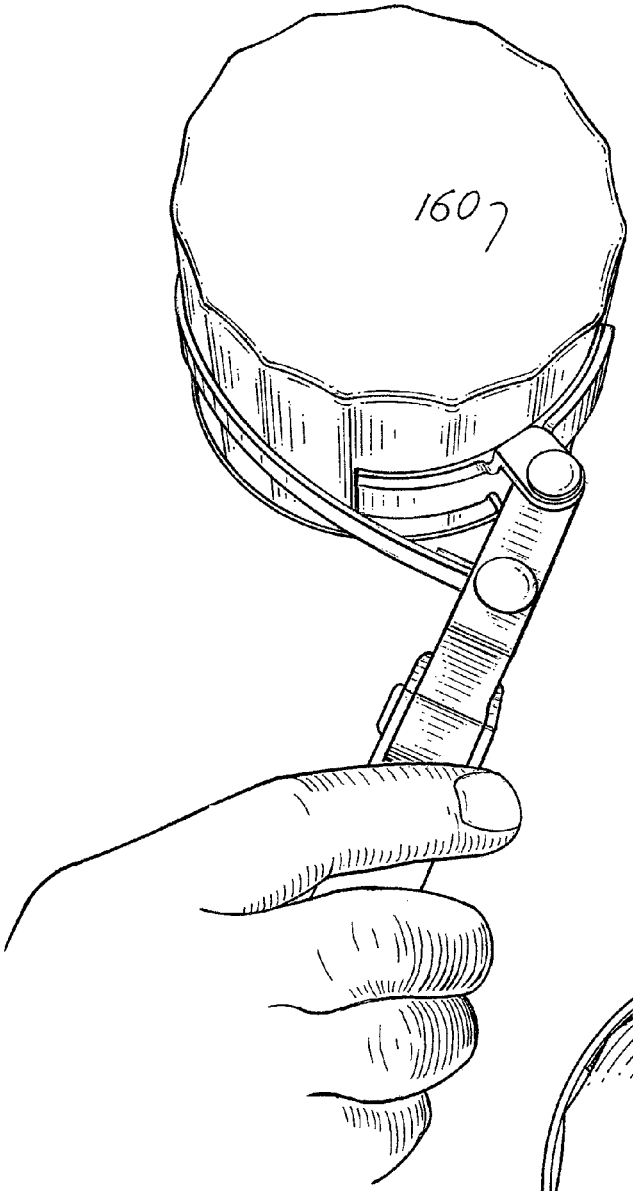
FIG. 7
FIG. 8
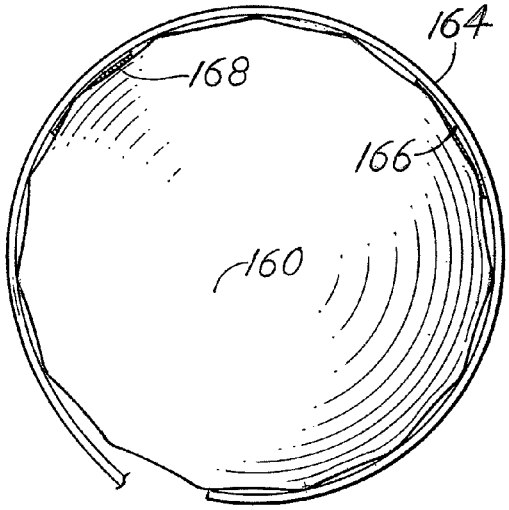

FIG.9
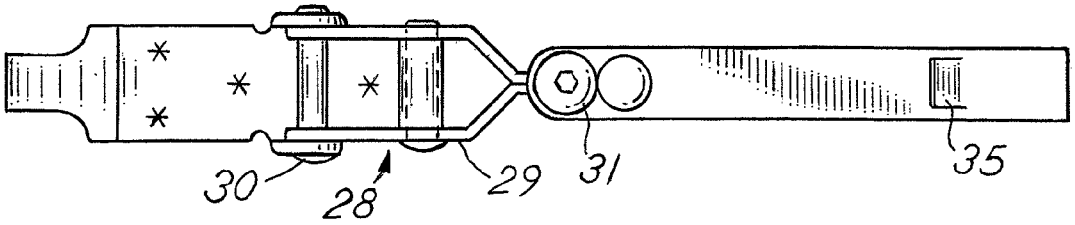
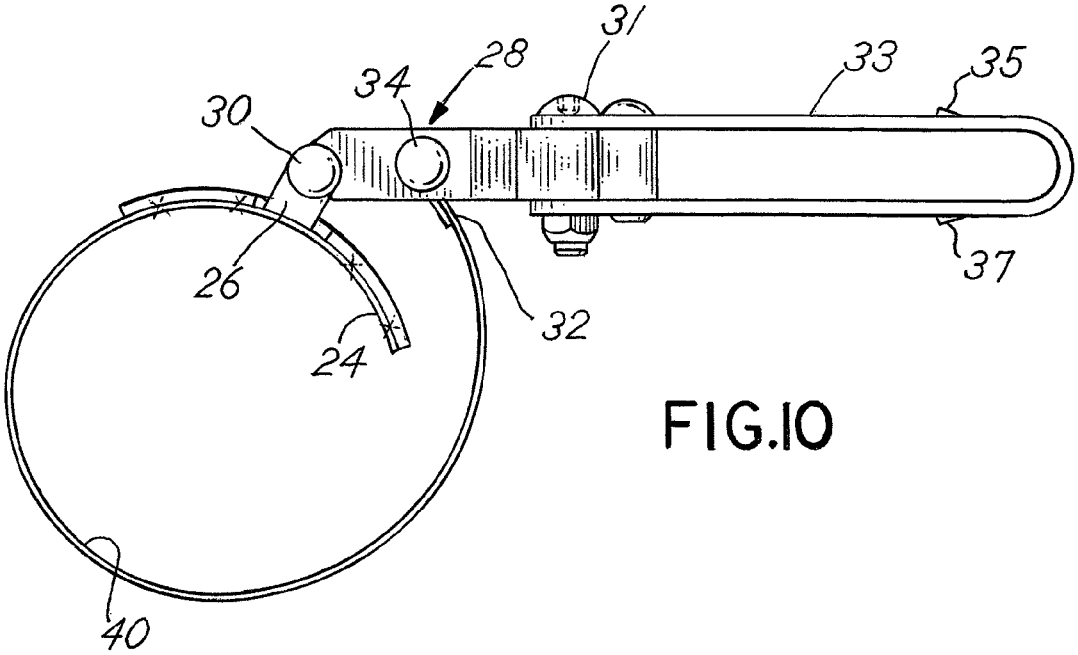
FIG.10
FIG.11
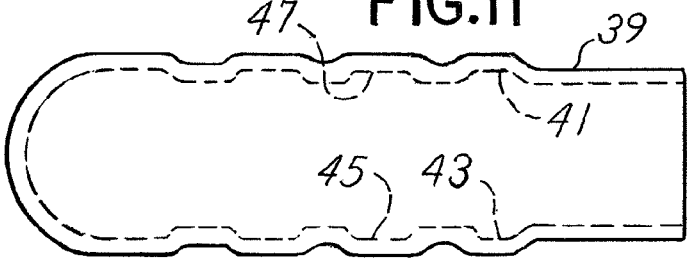
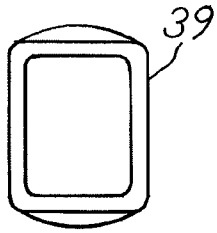
FIG.13
FIG.12
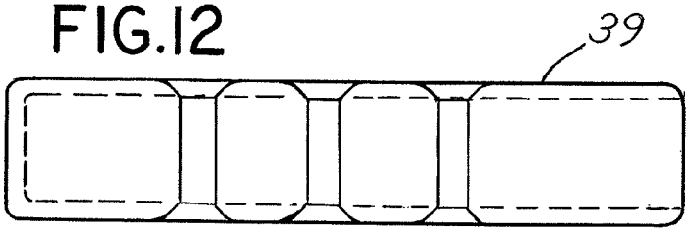

OIL FILTER WRENCH

CROSS REFERENCE TO RELATED APPLICATIONS

This is a utility application incorporating by reference, claiming priority to and derived from the following provisional applications: (1) Application Ser. No. 61/092,611, filed Aug. 28, 2008, entitled "Oil Filter Wrench" and (2) Application Ser. No. 61/184,325, filed Jun. 5, 2009, entitled "Oil Filter Wrench".

BACKGROUND OF THE INVENTION

In a principal aspect the present invention relates to an oil filter wrench, or wrench of similar purpose, useful for engaging and turning cylindrical bodies, such as an oil filter canister.

When servicing motor vehicles, and, in particular, motor vehicle engines, a typical task is the replacement of the oil filter canister which usually has a cylindrical shape. There are various patents which disclose tools for removal and replacement of such oil filter canisters. By way of example, U.S. Pat. No. 5,388,485 discloses a typical oil filter wrench construction. Similarly, U.S. Pat. No. 5,090,274 discloses another type of oil filter wrench. These patents are incorporated by reference. Oil filter wrenches of this general nature employ a flexible band formed generally in the configuration of a hoop. The hoop is connected to a lever arm which may be manipulated to tighten the band around a cylindrical canister. The band may then be torqued or turned by the handle to tighten or release the cylindrical canister.

Another type of oil filter or canister removal wrench construction is represented by U.S. Pat. No. 5,595,094 incorporated by reference. This type of wrench construction has the configuration of a pliers wherein opposed semi-cylindrical jaws are designed to grip and turn a cylindrical canister such as an oil filter canister.

A problem associated with various oil filter wrench designs is the lack of gripping power by the band or wrench jaws on the canister. U.S. Pat. No. 5,388,485 discloses the use of an abrasive inner surface on the band to enhance gripping contact between the band and the canister which is to be rotated or unscrewed from a housing. Other gripping constructions include punched holes or detents in the band or teeth in the gripping jaws, for example, as depicted in U.S. Pat. No. 5,595,094. The described devices, though useful, exhibit various problems. For example, the abrasive material may separate from the band or the detents or teeth may damage the canister during removal or installation. Thus an improved construction is desired.

SUMMARY OF THE INVENTION

Briefly, the present invention comprises a flexible band, canister wrench wherein the inside surface of the band includes a patterned layer of abrasive, fused metal. The fused metal is applied in a manner that provides a wear resistant, abrasive surface pattern on the inside surface of the band that significantly enhances gripping by the oil filter wrench flexible band. This is accomplished by fusing an alloy to the metallic band, inside gripping surface. The fused alloy in various embodiments typically covers only a portion of the inside gripping surface of the band and is formed in a pattern to enhance its utility.

The alloy which is utilized in the practice of the invention to form an abrasive pattern is typically a stainless steel alloy; in particular cobalt based, high hardness alloys. It may be fused to the inside surface of the oil filter wrench band by welding techniques. Thus, the alloy is integrated with and fused to a flexible stainless steel band along the inside surface thereof.

Applicant also discovered that the entire inside surface of the oil filter wrench, flexible stainless steel band need not be coated with the fused alloy. Rather, at least about 4% to about 20% of the inside surface may be coated. Such coverage in combination with an appropriate pattern of coverage by the fused alloy results in a surface that is adequately rough to engage cylindrical items such as oil filter canister and effect their removal and/or installation. Additionally, by eliminating the need to coat or cover the entire surface, the manufacturing process is significantly affected in a positive manner. That is, the cost of applying the coating is significantly reduced because the amount of the surface area to be coated is reduced. The coated or covered surface area also is preferably patterned in any one of a number of very desirable patterns which facilitate the utilization of the oil filter wrench for removal of multiple sizes of cylindrical objects as well as the gripping of cylindrical objects which may include fluted circumferential surfaces rather than a smooth constant diameter cylindrical surface. Patterns which have been found effective include spaced arrays of rectangular sections or patches on the inside surface of the flexible band of the oil filter wrench. The rectangular sections or patches or areas are sized and spaced appropriately to insure uniform gripping of a cylindrical filter.

Further, applicant has designed a handle and grip combination for use in association with the oil filter wrench wherein the grip is more effectively retained in place in combination with the actuating handle of the wrench. Thus, the handle includes molded or formed projecting tabs, nubbins or teeth which are designed to engage within detents or slots or openings in the grip. Thus, when the oil filter wrench becomes contaminated with oil, the grip will not easily slide from the handle.

Thus, it is an object of the invention to provide an improved oil filter wrench.

A further object of the invention is to provide an improved oil filter wrench wherein the wrench is comprised of a handle pivotally connected or joined to a stainless steel band which has an abrasive coating on the inside surface thereof wherein the coating is comprised of a steel alloy material (e.g. high hardness cobalt based steel) fused or bonded to the stainless steel band.

Yet another object of the invention is to provide an improved wrench which includes materials fused to the wrench gripping surface and which significantly enhance the gripping ability of the wrench compared to prior art wrenches and further compared with wrenches having grit, rubber and other materials affixed to the gripping surface thereof.

Yet another aspect or object of the present invention is to provide an oil filter wrench which does not require the inclusion of detents, punches or deformation of the band gripping surface of the oil filter wrench and which instead includes material bonded to the gripping surface thereof to enhance the gripping ability of the wrench.

Another object of the invention and the aspect associated with its construction is the utilization of a mechanism or means for retaining the hand grip upon the actuating handle of the oil filter wrench to enable retention of the grip even when contaminated or made slippery by the virtue of oil spilling thereon.

These and other objects, advantages and features of the invention will be set forth in the detailed description which follows.

BRIEF DESCRIPTION OF THE FIGURES AND DRAWING

Briefly, an embodiment of the invention is depicted in the following figures and drawings including photographs of a prototype product as follows:

FIG. 1 is a photograph of an oil filter wrench formed from a flexible metal band with a lever arm attached to the band that may be manipulated to adjust the size of the cylindrical opening formed by the band so that it may be tightly gripped about or removed from a cylindrical canister;

FIG. 2 is a photograph of the tool of FIG. 1 as viewed from the opposite side thereof;

FIG. 5 is a plan view of a band having a pattern of fused alloy coating on the inside surface thereof;

FIG. 5A is a sectional view of the band of FIG. 5 taken along the line 5A-5A;

FIG. 5B is a top plan view of the wrench of the invention;

FIG. 5C is a side view of the wrench of FIG. 5B;

FIG. 6 is a top plan view of an alternate embodiment of the inside surface of a band for the wrench of the invention;

FIG. 6A is a cross sectional view taken along the line 6A-6A of FIG. 6;

FIG. 6B is a side plan view of a wrench incorporating the band of FIG. 6;

FIG. 7 is a photograph of an embodiment of the oil filter wrench of the invention as positioned on a oil filter;

FIG. 8 is a top plan view photograph and drawing depicting the pattern of the alloy coating on the inside surface of the band of an oil filter wrench as it would interact with the flutes of a typical oil filter; and FIG. 9 is a side elevation of the oil filter wrench depicting the handle with projecting tabs molded or integrated therein;

FIG. 10 is a side elevation of the handle construction of FIG. 10 viewed in the direction of the arrow further illustrating the projecting tabs;

FIG. 11 is a plan view of a grip which is attached to or slides onto the handle grip as depicted in FIGS. 9 and 10;

FIG. 12 is a side view of the grip of FIG. 11; and

FIG. 13 is an end view of the grip of FIG. 11.

DESCRIPTION OF AN EMBODIMENT OF THE INVENTION

Figure 3:
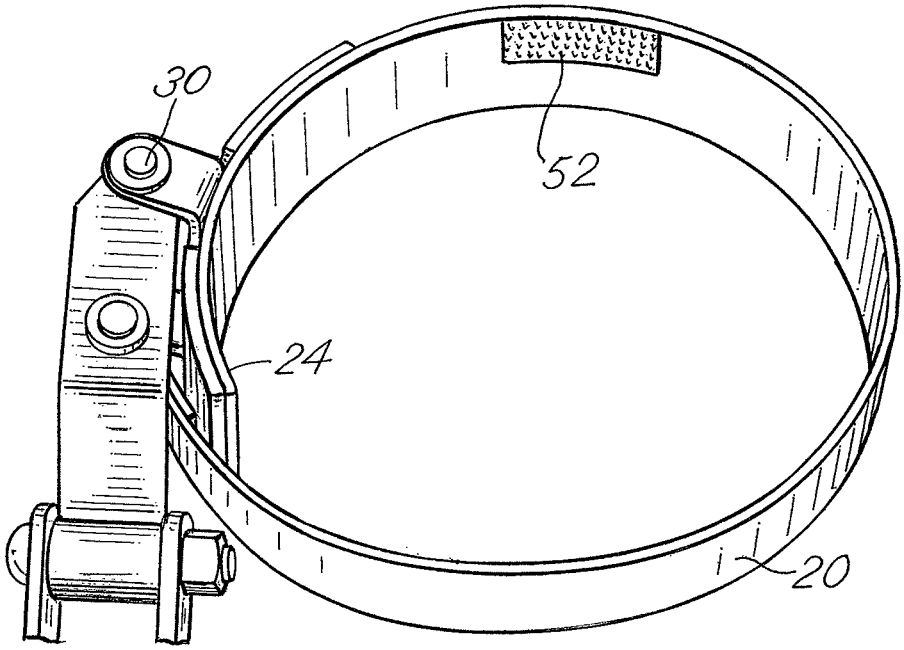
FIG. 3 is a photograph of the inside surface of the metal band employed with the oil filter wrench of FIGS. 1 and 2.
Figure 4:
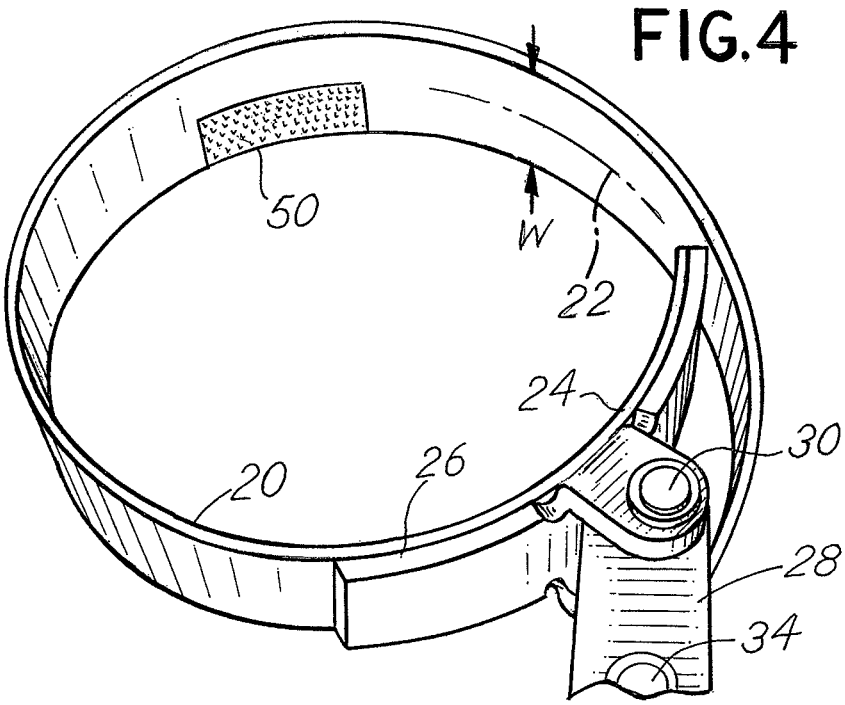
FIG. 4 is another photograph of the oil filter wrench of FIGS. 1 and 2 depicting in more detail a portion of the pattern of the abrasive, fused alloy on the band.

Referring to the figures, the embodiment depicted in FIGS. 1-4 comprises a metallic band 20 which is generally circular and includes a width dimension in FIG. 4 represented by the width W and a longitudinal axis 22 along the elongate dimension. The band 20 terminates at one end or a first end 24 where it is attached to a bracket 26 associated with a lever arm 28 for pivoting about a first pivot connection 30. The opposite end or second end 32 of the band 20 is attached to a second pivot 34 of the lever arm 28.

The lever arm 28 is comprised of a bracket member 29 which is attached by a pivot bolt 31 to a handle member 33. Handle member 33 may thus pivot about the axis of bolt 31. The handle member 33 is a molded, elongate member designed for manual gripping and for pivoting about the axis of the bolt 31 in order to position the oil filter wrench in a desired manner for removal or installation of a canister. As depicted in FIGS. 9 and 10, the lever arm 28 and, more particularly, the handle 33 includes a first projecting nub or tab 35 on one side and a second opposite side tab 37 on the opposite side or face thereof. The tabs 35 and 37 are designed to be engage with a molded vinyl grip such as grip 39 illustrated in FIGS. 11-13. That is, the grip 39 is molded or formed with a series of internal slots such as slots 41, 43, 45 and 47 which upon sliding of the grip 39 over the handle 33 will engage with and be retained by the tabs 35 and 37. In the event oil spills on the handle 33, the grip 39 will be retained thereon by the action of the tabs 35 and 37 enabling the oil filter wrench to exhibit improved safety since it is more difficult for the grip 39 to accidentally slide from the handle 33.

The band 20 may be constricted by pivoting the lever arm 28 about the generally parallel pivot axes 30 and 34. This will enable the band 20 to be tightened about a canister.

A feature of the invention is the inclusion of an alloy which is fused to the inside surface 40 of the band 20. The band 20 may be typically made from a stainless steel such as 303 stainless steel. A material which is fused to the stainless steel band may be acquired from various sources and applied using available commercial technology. A known source for providing applicatior technology is Carbinite Metal Coatings of Butler, Pa. which employs a technique to apply fused metal coatings identified with the trade name Carbinite™.

The band 20 thus has an elongate dimension along the longitudinal axis 22 and a width W with a pattern of alloy material fused thereto along at least a portion of the inside surface of the band 20. In one embodiment, the fused material is in the form or pattern of rectangles; namely, the rectangle 50 in FIG. 4 and a second rectangle 52 in FIG. 3. The rectangular portions 50, 52 have a longitudinal dimension in the direction of the axis 22 greater than their width dimension. The width dimension is approximately one half the width W of the band 20. The length dimension is in the embodiment depicted in the range of ½ to 1½ inches. Additionally, the patterned portions 50 and 52 are typically located along alternating opposite edges of the band 20. The patterns 50 and 52 are spaced approximately one quarter of the circumference of the generally circular band 20 so that a cylinder which is gripped thereby will be engaged at appropriately spaced positions typically equally spaced positions. By having the portions or patterns 50 and 52 on alternate or opposite edges of the band 20 and appropriately spaced, balancing of the torque on a cylindrical canister which is being removed or installed can be effected. Further, the longitudinal or axial dimension of the patterns 50 and 52 enables the pattern portions 50, 52 to fit over two or more flutes of a canister which has flutes formed on the outside surface. The described pattern insures engagement of the band 20 with adequate surface area of the canister that is to be gripped. The spacing of alloy pattern portions 50, 52 longitudinally is considered desirable in order to enhance the gripping action of the band in a uniform manner as it is tightened about a canister.

The pattern of the alloy material which is fused to the band 20 may be applied to provide various roughness sizes termed grit size. A preferred grit size is identified as Grade No. 4 per the Carbinite referenced process. It has been discovered that the average particle size found most desirable with respect to the practice of the invention is equivalent to a grit size wherein the grit particles have a average particle diameter in the range of 530 plus or minus 60 μm. Of course, the particles overlap, are fused together and are integrated into the surface of the band 20. In other words, a fusing process integrates the alloy coating material out and into the stainless steel band. The coating is not a smooth coating but rather is a coating which provides a rough surface generally equivalent to multiple fused particles having the grit size standards which are set forth herein. It is also noted that it is desirable to have the hardness of the fused alloy to exceed Rockwell hardness of 50 and preferably greater than 70.

Further features and characteristics are illustrated in FIGS. 5, 5A, 5B and 5C. Referring to FIGS. 5, 5A, 5B and 5C, a band 100 includes an inside surface 102 having a pattern of generally rectangular coating material sections 104, 106, 108 and 110. The length of the band is variable in the range of 6-15 inches, although greater lengths may be utilized in the practice of the invention. The coated or fused, material surface area of the band on the inside surface is typically at least about 4% thereof up to approximately 20%. Of course, the entire surface may be coated, but the expense and technical difficulties to apply a coating on the entire surface may be economically prohibitive. Moreover, it has been discovered that a minimum of about 4% coverage is adequate and that it is very unnecessary, surprisingly, to require more than 20% of the surface area to be coated with the fused alloy or coating material described. Typically, the width of the band 100 is in the range of about ½ to 2 inches. Again, the width may be varied depending upon the size of the oil filter wrench. The range of dimensions is thus dependent upon the ultimate use of the wrench and may be varied to accommodate the diameter of the object which is to be engaged by the wrench.

Typically, the thickness of the coating is depicted in section A-A of FIG. 5 and is in the range of 0.02 to 0.06 inches. The thickness of the coating is thus about ½ the thickness of the uncoated band 100.

As shown in FIGS. 5, 5A, 5B and 5C, the component parts of a typical oil filter wrench include a handle or lever arm 114 with a hand grip end 116 and an opposite lever end 118 having a first pivot 120 and a second pivot 122 to which the pivot connections of band 100 are attached. The axes of the pivot connections are parallel and transverse to the longitudinal dimension of the band 100.

As shown in FIG. 5, the sections or portions of the coating material 104, 106, 108 and 110 have substantially the same size, shape and thickness and are spaced from one another generally uniformly. The spaced sections 104 and 108 are placed along alternate or opposite edges or sides of the band 100. Various patterns of placement of the sections 104, 106, 108 and 110 may be utilized. A rectangular configuration of the sections 104, 106, 108, 110 is preferred. Each section preferably is at least 0.5 square inches in area. However, either section patters such as circular, oval and triangle may be adopted.

The alloy which is utilized and bonded or fused to the band 100 preferably has a hardness of at least 300 (Vickers Pyramid measurement). Various alloys may be used. For example, stellite alloys designated as alloy No. 21 or alloy No. 6 available from Deloro Stellite of Swindon, in the United Kingdom, are alloys which typically may be utilized and applied using welding techniques. The alloys are typically a cobalt based, high hardness, stainless steel alloy and are rust resistant. The coated sections are spaced at least 0.375 inches. The elongate dimensions of the rectangular coated sections are typically in the range of one inch but may be varied in accord with desires. Of course, the configuration of the coated sections may be varied also, but it has been found that a rectangular configuration facilitates manufacturing as well as utilization of the ultimate tool.

Typically, at least two patterned sections and preferably three or more equally spaced, patterned sections are utilized. Typically, they are equally spaced in the longitudinal dimension, but that may also be varied depending upon desires and needs with respect to the utility of the tool.

Referring next to FIGS. 6, 6A and 6B, dimensional characteristics of the band 150 are depicted. In this embodiment the band 150 has a narrower dimension in the range of ½ inch. The band is uniformly wide along at least a portion of its length. The band 150 includes a coated section 152, by way of example, on the inside face or surface. Again, the coated section exemplified by cross section 5A-5A is in the range of 0.02 or more inches thickness.

Referring next to FIG. 7 there is illustrated the manner of use of the oil filter wrench tool. The outer surface of an oil filter 160 is gripped by an oil filter wrench of the type described and the wrench is manipulated to tighten the band about the circumference of the oil filter 160. The handle of the oil filter wrench may then be further manipulated to effect rotation of the oil filter 160.

FIG. 8 is a top view of a typical oil filter 160. A band 164 is shown partially fitted about the circumference of the oil filter 160. The inside surface of the band 164 includes a first coated area 166 and a second coated area 168. It will be noted that the dimensional characteristics of the coated areas 166 and 168 are such that they overlap at least two flutes on the outside face of the oil filter 160 and are spaced so that multiple flutes will be engaged. Thus, it is important to recognize that positioning of alloy coated sections along the longitudinal length is a factor with respect to the efficiency and utility of the invention. Spacing of the coated sections and their dimensions are chosen to enable the engagement of multiple flutes and spaced sections of the circumferential surface of a cylinder in a typical situation so that the utility of the oil filter wrench is assured.

The use of the described material as a coating material does not degrade the stainless steel band which is placed around an oil filter during the use of the tool. The tool (particularly the band an fused coating) is resistant to degradation due to cracking or stresses that may build up as a result of its use even though the coating material bonds and is fused into the surface of the band. The metallurgical bond between the facing material and the band is thus a highly desired aspect of the development.

While there has been set forth preferred embodiments of the invention, the invention is limited only by the following claims and equivalents.

What is claimed is:

1. In a swivel grip oil filter wrench including:

(a) a lever arm handle assembly having a handle grip end section and an opposite pivot connection end, said pivot connection end including a first and a second pivot connections, said first pivot connection spaced from the second pivot connection, each pivot connection having a pivot axis, said axes generally parallel to each other;

(b) an elongate, flexible, steel alloy metal band having a planar inside surface, an elongate dimension extending between a first end and a second end of said band, said band having a generally uniform width band section with generally parallel first and second lateral side edges extending along at least a portion of the elongate dimension, said first pivot connection of the handle pivotally attached to a first pivot connection of said band and said second pivot connection of said handle attached to a second pivot connection of said handle, said first and second pivot connections of the band longitudinally spaced whereby the handle is rotatable about the pivot axes to alter the circumferential dimension of the band, the improvement comprising (c) an alloy coating of grit particles, metallurgically bonded to at least about 4% to about 20% of the inside surface of said band section, said alloy coating forming an abrasive grit surface pattern on the inside surface of said band section, said surface pattern comprising at least two separate, generally uniformly sized and shaped, generally rectangular alloy sections of generally uniform thickness, each said rectangular alloy section having a side positioned along one of said first and second lateral side edges of the band section, each separate alloy section covering only a portion of said inside surface of said band section between said first and second lateral side edges, said alloy sections separated from each other in the elongate dimension direction of said band, and at least one side of said alloy sections aligned along said first lateral side edge of said band section and at least one side of another of said alloy sections aligned along said second lateral side edge of said band section.

2. The wrench of claim 1 wherein the elongate dimension is in the range of about 6 to 15 inches.

3. The wrench of claim 1 wherein the spaced alloy sections are generally equally spaced in the elongate dimension direction of the band.

4. The wrench of claim 3 wherein the spaced alloy sections are alternately located on opposite first and second lateral side edges.

5. The wrench of claim 1 wherein the coating comprises a high hardness, cobalt based stainless steel alloy bonded to the inside surface.

6. The wrench of claim 5 wherein the alloy has a Vickers hardness of at least about 300.

7. The wrench of claim 1 wherein the alloy sections have a major dimension generally parallel to the elongate dimension direction.

8. The wrench of claim 1 wherein the abrasive surface pattern of said alloy on the inside surface has a Rockwell hardness greater than about 50.

9. The wrench of claim 1 wherein the abrasive grit surface pattern on the inside surface has a Rockwell hardness greater than 70.

10. The wrench of claim 1 wherein the alloy coating has a thickness in the range of about 0.02 to 0.07 inches.

11. The wrench of claim 1 wherein the alloy coating is a carbide stainless steel alloy formed from grit particles having an average grit particle size in the range of about 560±60 μm.

12. The wrench of claim 1 comprising four alloy sections equally spaced from each other in the elongate dimension direction.

13. The wrench of claim 12 wherein an equal number of alloy sections are aligned along the first and second lateral side edges.

* * * * *